US006283449B1

(12) United States Patent
Hu

(10) Patent No.: US 6,283,449 B1
(45) Date of Patent: Sep. 4, 2001

(54) HAMMER WITH A NAIL DIGGING FUNCTION

(76) Inventor: Bobby Hu, 8F, No. 536-1, Ta Chin Street, Taichung (TW)

( * ) Notice: Subject to any disclaimer, the term of this patent is extended or adjusted under 35 U.S.C. 154(b) by 0 days.

(21) Appl. No.: 09/425,350

(22) Filed: Oct. 22, 1999

(51) Int. Cl.[7] ..... B25F 1/00
(52) U.S. Cl. ..... 254/26 R
(58) Field of Search ..... 254/25, 26 R, 254/26 E, 27, 28

(56) References Cited

U.S. PATENT DOCUMENTS 960,193 * 5/1910 Peterson ..... 254/25
2,330,092 * 9/1943 Vanesse ..... 254/26 R
4,776,568 * 10/1988 Perel ..... 254/25

FOREIGN PATENT DOCUMENTS

135131 * 11/1919 (GB) ..... 254/26 R
74511 * 1/1949 (NO) ..... 254/26 R

* cited by examiner

*Primary Examiner*—Robert C. Watson
(74) *Attorney, Agent, or Firm*—Alan Kamrath; Rider, Bennett, Egan & Arundel, LLP

(57) ABSTRACT

A hammer includes a handle and a head attached to an end of the handle. The head includes an end with a pair of claws having a nail extracting slit therebetween for extracting nails. At least one of the claws has a nail-digging arrangement formed on a distal free end thereof for digging a nail. The nail-digging arrangement includes two branches with a nail receiving slit therebetween, the nail receiving slit being defined by an arcuate, slanted surface. Each branch has an end face processed to form a chamfered slanted face that faces upward and outward. Each chamfered slanted face includes a lower edge, the two lower edges of the chamfered slanted faces together forming an arrow configuration, thereby forming a three-dimensional nail digging section consisting of the chamfered slanted faces, the arcuate, slanted face, and the lower edges.

20 Claims, 9 Drawing Sheets

HAMMER WITH A NAIL DIGGING FUNCTION

BACKGROUND OF THE INVENTION

1. Field of the Invention

The present invention relates to a hammer that provides a nail digging function for digging nails that cannot be extracted easily.

2. Description of the Related Art

FIG. 8 of the drawings illustrates a conventional hammer with a pair of claws 80 with a slit 81 therebetween for extracting a nail 60 from a wooden plate. However, only a nail with a head beyond the surface of the wooden plate can be extracted. As illustrated in FIG. 9, a nail with a head buried in the wooden plate cannot be extracted easily. Forcible extraction of the nail may damage the wooden plate. In addition, the claw 80 of the hammer is designed to extract larger nails only. The present invention is intended to provide a hammer with a digging function to solve these problems.

SUMMARY OF THE INVENTION

A hammer in accordance with the present invention comprises:

a handle;

a head attached to an end of the handle, the head including an end with a pair of claws having a nail extracting slit therebetween for extracting nails; and at least one of the claws having a nail-digging means formed on a distal free end thereof for digging a nail.

Each claw includes a slanted inner face that defines a portion of the nail extracting digging slit, and wherein the slanted inner face guides upward movement of the nail during extraction of the nail.

The nail-digging means includes a nail receiving slit in a mediate portion thereof and defined by an arcuate, slanted surface. In a preferred embodiment of the invention, the nail-digging means includes two branches separated by the nail receiving slit. Each branch has an end face processed to form a chamfered slanted face that faces upward and outward. Each chamfered slanted face includes a lower edge, the two lower edges of the chamfered slanted faces together forming an arrow configuration, thereby forming a three-dimensional nail digging section consisting of the chamfered slanted faces, the arcuate, slanted face, and the lower edges.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
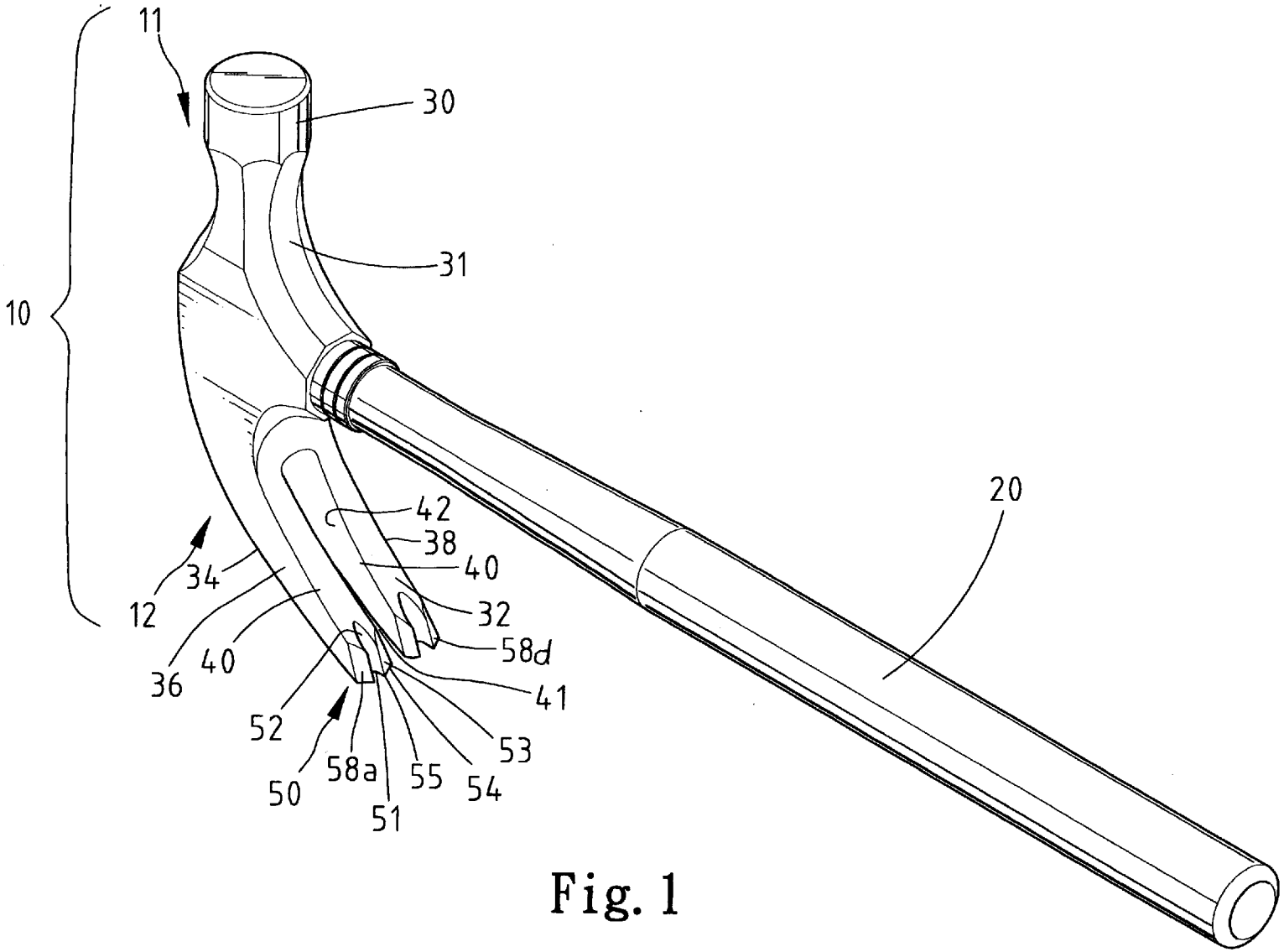
FIG. 1 is a perspective view of a hammer in accordance with the present invention.

Referring to FIG. 1, a hammer in accordance with the present invention generally includes a handle 20 and a head 10 attached to an end of the handle 20. The head 10 includes a first end 11 and a second end 12. A peen 30 is formed on the first end 11 and a neck 31 is provided below the peen 30. The second end 12 of the head 10 includes an inner surface 32, an outer surface 34, a first outer face 36, and a second outer face 38. A pair of claws 40 is defined by a nail extracting slit 41 therebetween for extracting nails. Each claw 40 includes a slanted inner face 42 that defines a portion of the nail extracting slit 41, the slanted inner face 42 being provided for guiding upward movement of the nail during extraction.

Figure 4:
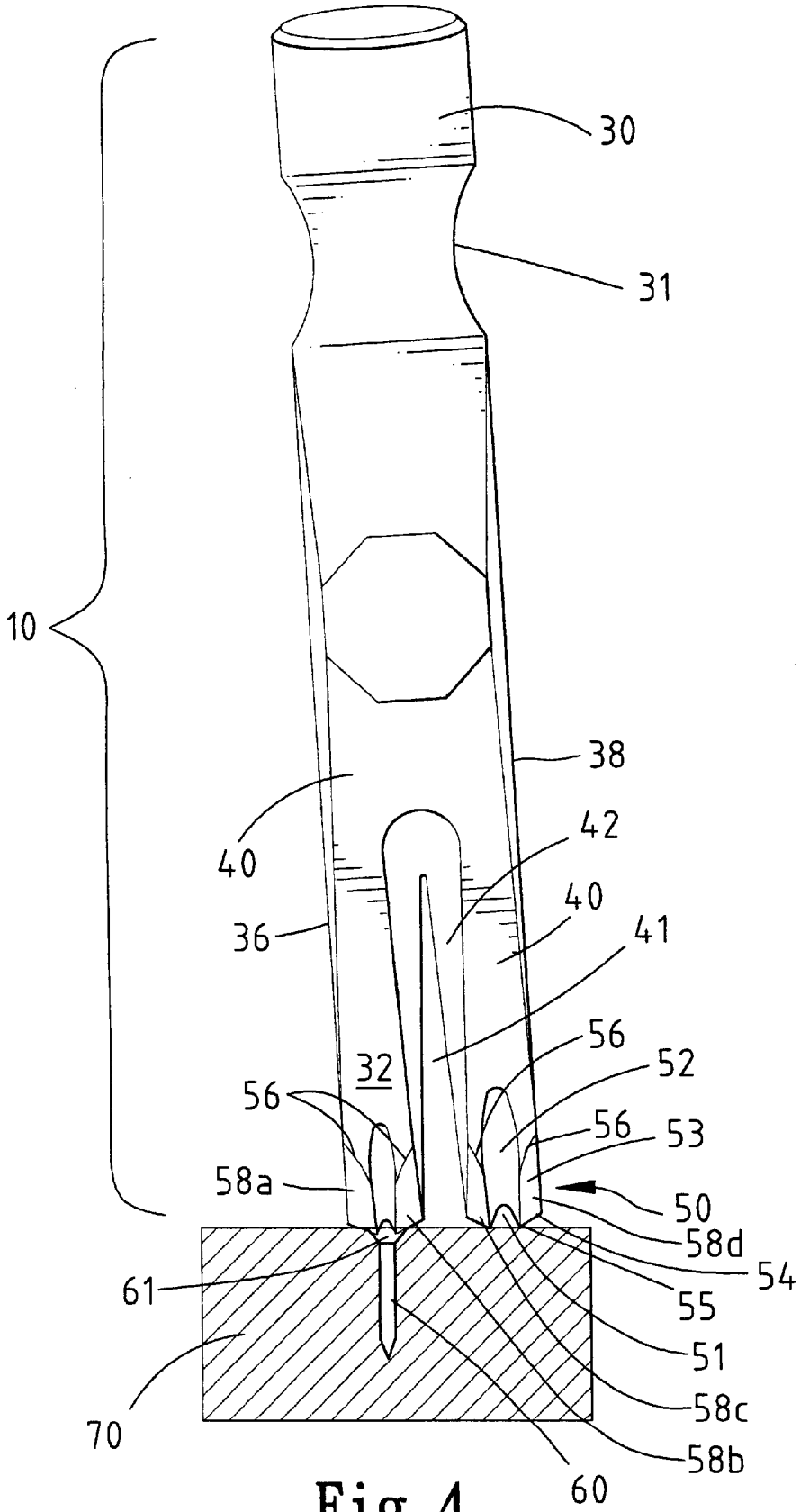
FIG. 4 is a front view, partially sectioned, illustrating the nail digging by the hammer in accordance with the present invention.
Figure 7:
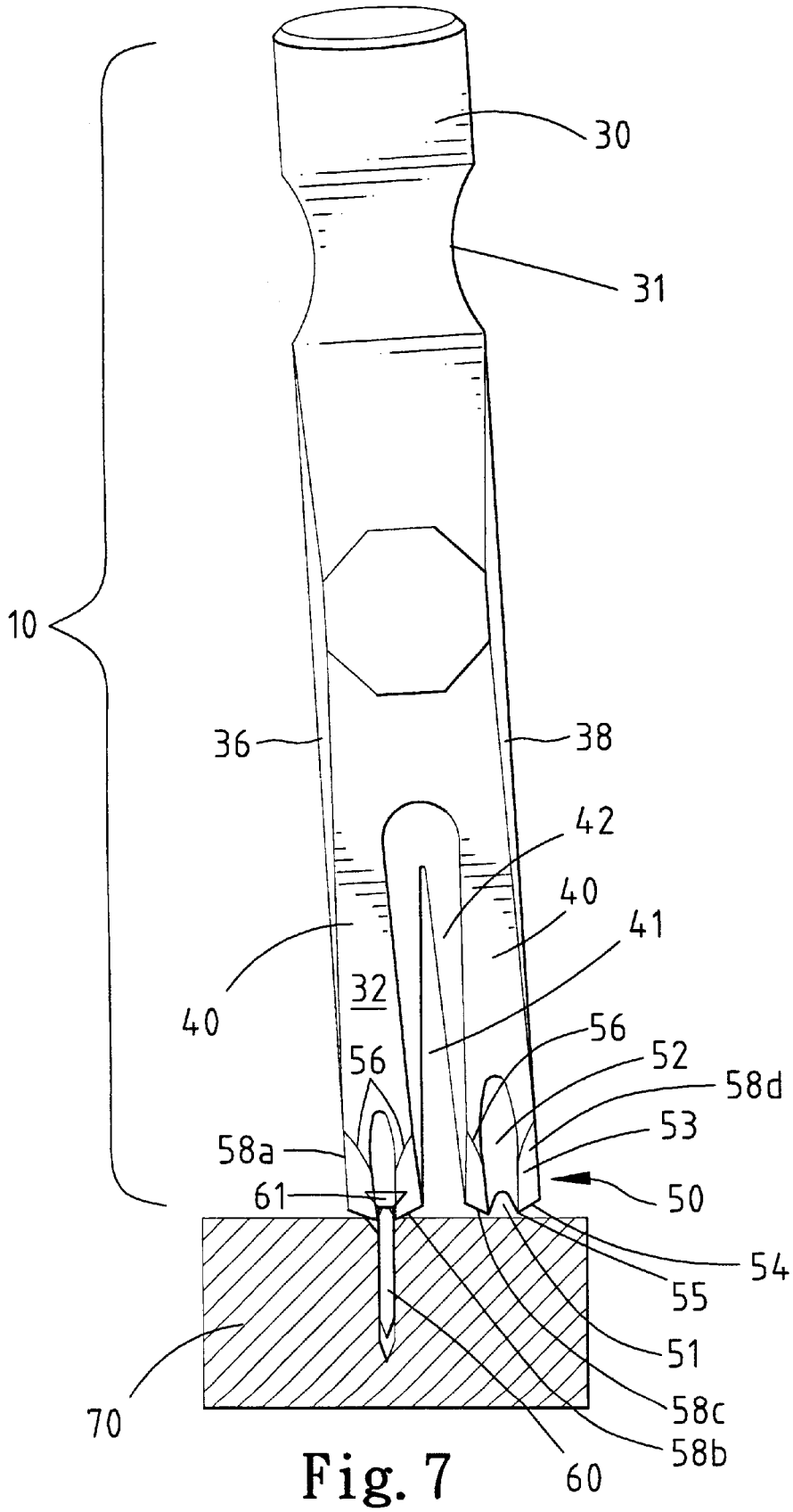
FIG. 7 is a front view, partially sectioned, illustrating completion of the nail digging by the hammer in accordance with the present invention.
Figure 8:
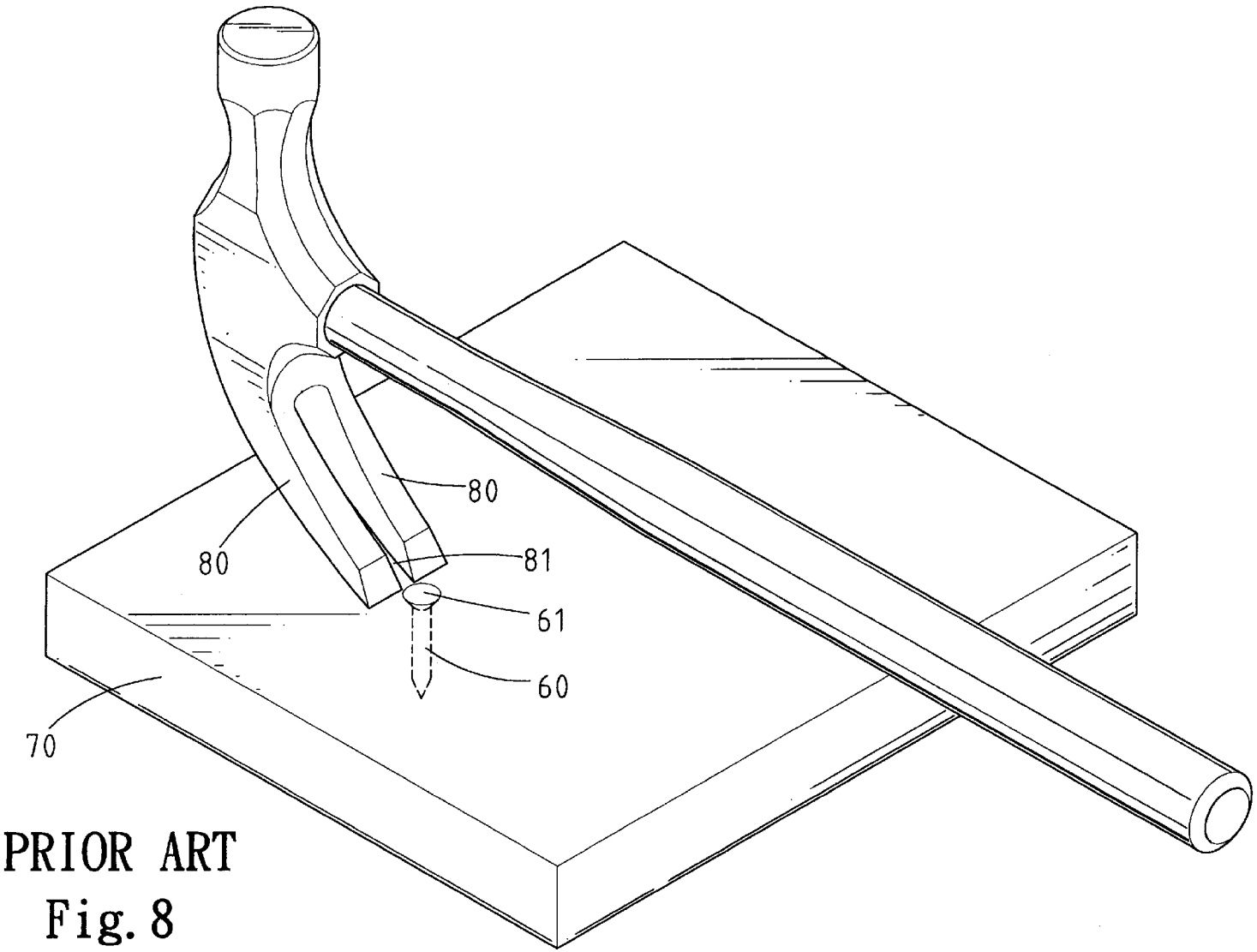
PRIOR ART Fig. 8
FIG. 8 is a perspective view illustrating nail extraction by a conventional hammer.
Figure 9:
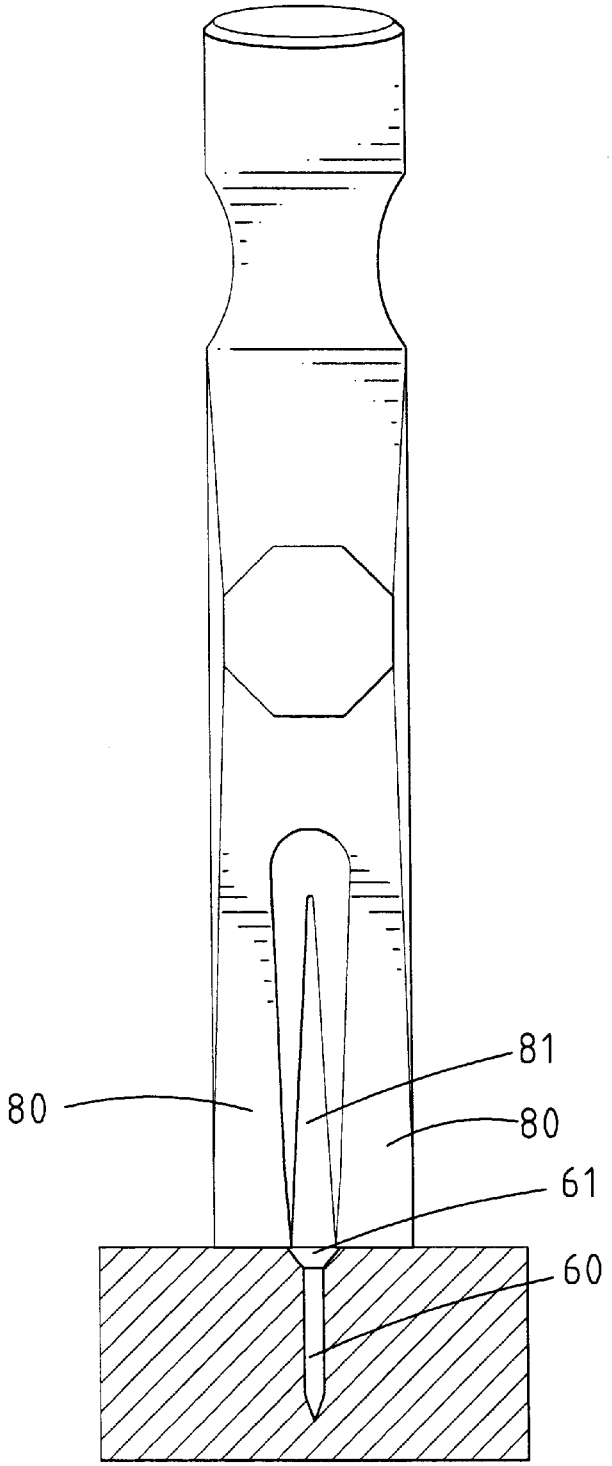
PRIOR ART Fig. 9
FIG. 9 is a front view, partly sectioned, of the conventional hammer and the nail in the wooden plate.

At least one of the claws 40 has a nail-digging means 50 formed on a distal free end thereof. The nail-digging means 50 includes a nail receiving slit 51 in a mediate portion thereof and defined by an arcuate, slanted surface 52. Thus, the nail-digging means 50 includes two branches 58*a*, 58*b*, 58*c* and 58*d* separated by the nail receiving slit 51. In other words, first and second inner faces 42 extend in a spaced relation between the inner and outer surfaces 32 and 34 and intermediate the first and second outer faces 36 and 38 to define the first nail extracting slit 41. The first of the pair of claws 40 is defined between the first inner face 42 and the first outer face 36 and the second of the pair of claws 40 is defined between the second inner face 42 and the second outer face 38. The second nail extracting slit 51 extends between the inner and outer surfaces 32 and 34 and intermediate the first inner face 42 and the first outer face 36. First and second branches 58*a* and 58*b* are defined between the outer face 36 and the second nail extracting slit 51 and between the first inner face 42 and the second nail extracting slit 51, respectively. Similarly, a third nail extracting slit 51 extends between the inner and outer surfaces 32 and 34 and intermediate the second inner face 42 and the second outer face 38. Third and fourth branches 58*c* and 58*d* are defined between the second inner face 42 and the third nail extracting slit 51 and the second outer face 38 and the third nail extracting slit 51, respectively. An end face of each of the first, second, third and fourth branches 58*a*, 58*b*, 58*c* and 58*d* is processed to form a chamfered slanted face 53 that faces upward and outward from its respective nail extracting slit 51. Each chamfered slanted face 53 of the branches 58*a*, 58*b*, 58*c* and 58*d* includes a lower edge 54 and an upper edge 56. As best seen in FIGS. 4 and 7, edges 54 and 56 of each chamfered slanted face 53 of the branches 58*a*, 58*b*, 58*c*, and 58*d* are spaced greater than the depth of nail extracting slits 51 from the outer surface 34. In the most preferred form, the third nail extracting slit 51 between the branches 58*c* and 58*d* is of a different size and specifically larger than the second nail extracting slit 51 between the branches 58*a* and 58*b*. First and second inner faces 42 and thus the first nail extracting slit 41 as well as the second and third nail extracting slits 51 extend from the end face (in the preferred form forming chamfered slanted face 53) of the second end 12. The two lower edges 54 together form an arrow-like configuration or in other words sides of a V-shape. Thus, a three-dimensional nail digging section 55 consisting of the chamfered slanted faces 53, the arcuate, slanted face 52, and the lower edges 54 is formed.

Figure 2:
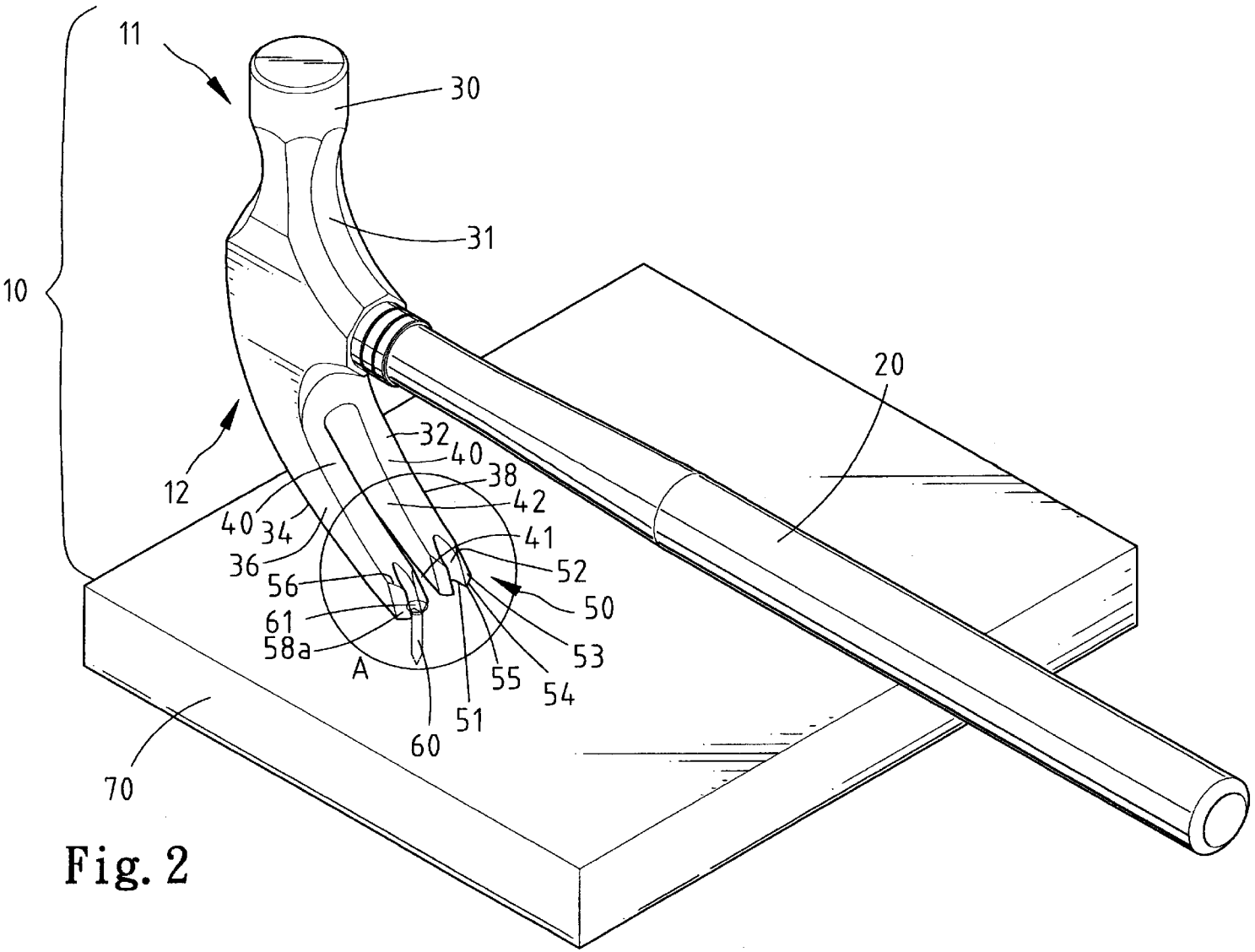
FIG. 2 is a schematic view illustrating nail digging by the hammer in accordance with the present invention.
Figure 3:
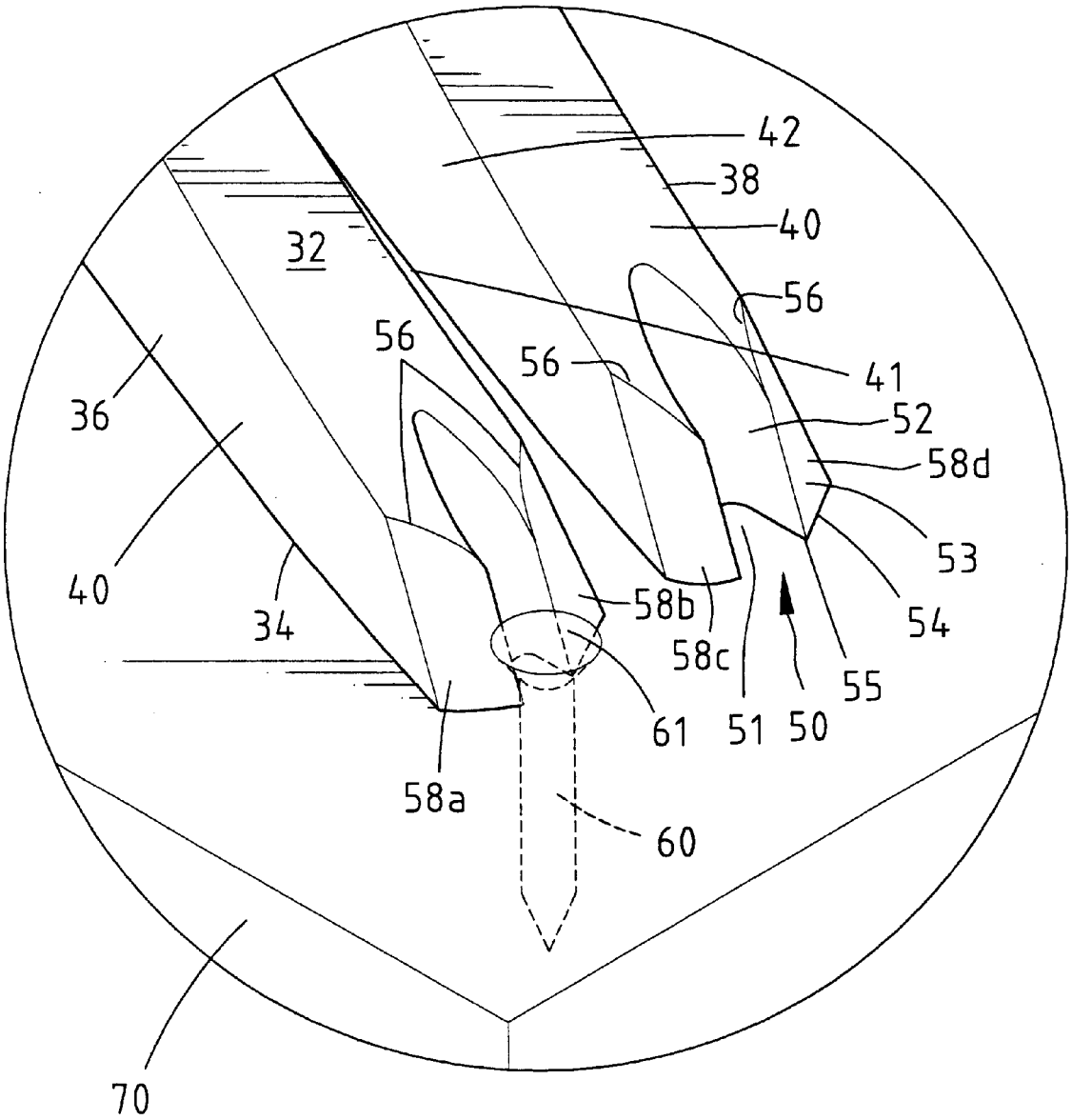
FIG. 3 is an enlarged view of a circle in FIG. 2, illustrating the nail digging by the hammer in accordance with the present invention.
Figure 5:
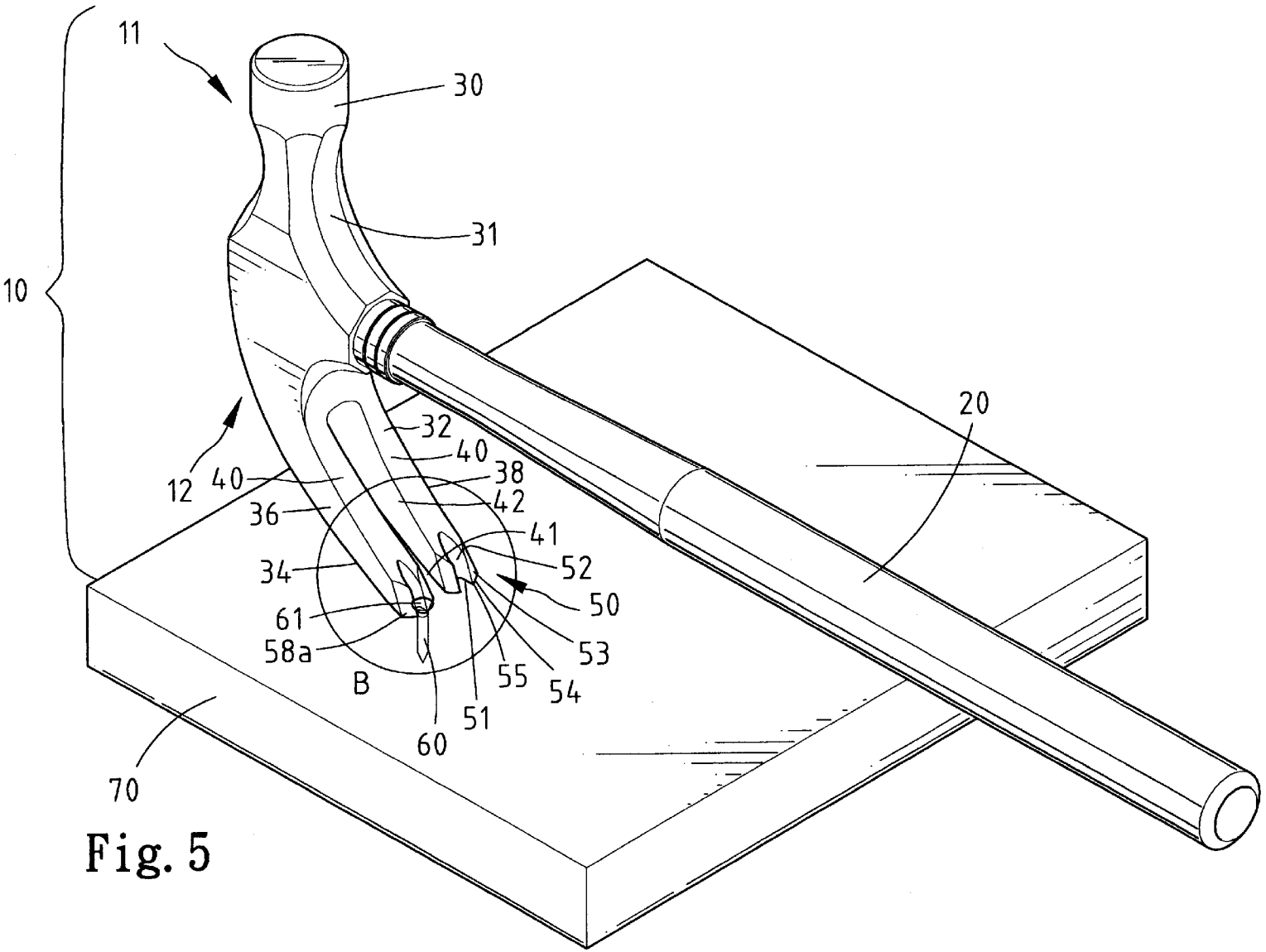
FIG. 5 is a schematic view illustrating completion of nail digging by the hammer in accordance with the present invention.
Figure 6:
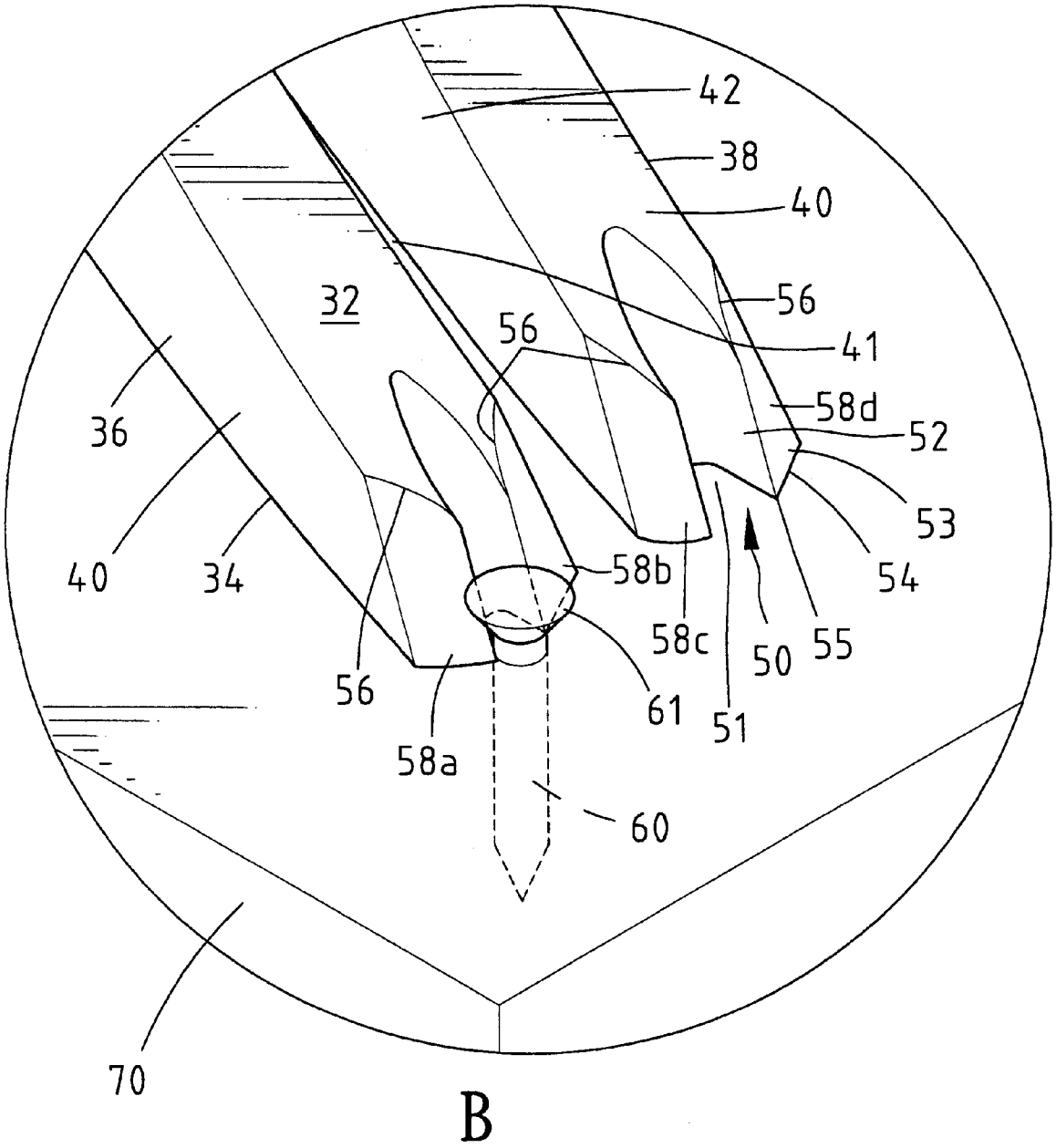
FIG. 6 is an enlarged view of a circle in FIG. 5, illustrating completion of the nail digging by the hammer in accordance with the present invention.

Referring to FIGS. 2, 3, and 4, in a case that the head 61 of a nail 60 is flush with the surface of a wooden plate 70, the user applies a force to make the digging section 55 pierce into the surface of the wooden plate 70 at an area around the nail head 61. The chamfered slanted faces 53 squeeze the wooden material located at two sides of the nail head 61 away such that the nail head 61 is guided into the nail receiving slit 51 when the user continues apply a force to the hammer. The nail 60 is further moved upward along the arcuate, slanted face 52. Thus, the nail 60 is moved upward when the user applies an upward force, as shown in FIGS. 5, 6, and 7. This is because lower edge of the nail head 61 is in contact with and thus supported by the arcuate, slanted face 52. Thus, the nail head 61 is above the surface of the wooden plate 70 for subsequent extraction by the claw 40 of the hammer, wherein the slanted inner faces 42 of the claws 40 assist in extraction of the nail 60 by means of guiding upward movement of the nail 60.

The surface of the wooden plate 70 is only damaged by a small area, as the digging section 55 is designed to pierce deeply into the wooden plate 70 and squeeze the wooden plate 70 by a minimized extent. In addition, the digging operation is simple and can be achieved easily.

Although the invention has been explained in relation to its preferred embodiment, it is to be understood that many other possible modifications and variations can be made without departing from the spirit and scope of the invention as hereinafter claimed.

What is claimed is:

1. A hammer comprising:

a handle;

a head attached to the handle, the head including an end having an inner surface and an outer surface, with the end having a pair of claws having a nail extracting slit therebetween for extracting nails, with the nail extracting slit extending between the inner and outer surfaces; and at least one of the claws having a nail-digging means formed on a distal free end thereof for digging a nail, the nail-digging means including a nail receiving slit in a mediate portion thereof, with the nail receiving slit having a depth from the outer surface, the nail-digging means including two branches separated by the nail receiving slit, each said branch having an outer chamfered slanted face that extends upward and outward and faces away from the nail receiving slit, each said chamfered slanted face including a lower edge and an upper edge, with the upper and lower edges of the chamfered slanted faces being spaced greater than the depth of the nail receiving slit, thereby forming a three-dimensional nail digging section consisting of the chamfered slanted faces, the nail receiving slit, and the lower edges.

2. The hammer as claimed in claim 1, wherein each said claw includes a slanted inner face that defines a portion of the nail extracting digging slit, and wherein the slanted inner face guides upward movement of the nail during extraction of the nail.

3. The hammer as claimed in claim 1, wherein the nail receiving slit is defined by an arcuate, slanted surface; and wherein the two lower edges of the chamfered slanted faces together form sides of a V-shape.

4. A head attached to a handle, comprising an end having an inner surface and an outer surface, with the end having a pair of claws having a nail extracting slit therebetween for extracting nails, with the nail extracting slit extending between the inner and outer surfaces; and at least one of the claws having a nail-digging means formed on a distal free end thereof for digging a nail;

the nail-digging means including a nail receiving slit in a mediate portion thereof, with the nail receiving slit having a depth from the outer surface, the nail-digging means including two branches separated by the nail receiving slit, each said branch having an outer chamfered slanted face that extends upward and outward and faces away from the nail receiving slit, each said chamfered slanted face including a lower edge and an upper edge, with the upper and lower edges of the chamfered slanted face being spaced greater than the depth of the nail receiving slit, thereby forming a three-dimensional nail digging section consisting of the chamfered slanted faces, the nail receiving slit, and the lower edges.

5. The head as claimed in claim 4, wherein each said claw includes a slanted inner face that defines a portion of the nail extracting digging slit, and wherein the slanted inner face guides upward movement of the nail during extraction of the nail.

6. The head as claimed in claim 4, wherein the nail receiving slit is defined by an arcuate, slanted surface; and wherein the two lower edges of the chamfered slanted faces together form sides of a V-shape.

7. A head for attachment to a handle, comprising: an end having an inner surface, an outer surface, an end face, a first outer face, a second outer face, and first and second inner faces extending in a spaced relation from the end face between the inner and outer surfaces and intermediate the first and second outer faces to define a first nail extracting slit, with a first claw being defined between the first inner face and the first outer face and a second claw being defined between the second inner face and the second outer face; a second nail extracting slit extending from the end face between the inner and outer surfaces and intermediate the first inner face and the first outer face, with the second nail extracting slit having a depth from the outer surface, with a first branch being defined between the first outer face and the second nail extracting slit and a second branch being defined between the first inner face and the second nail extracting slit, with the first and second branches each including a lower edge, wherein the end face of the first branch is a chamfered slanted face extending upward and outward from the second nail extracting slit and the end face of the second branch is a chamfered slanted face extending upward and outward from the second nail extracting slit, with the chamfered slanted faces of the first branch and of the second branch each including the lower edge and an upper edge, with the lower and upper edges of the chamfered slanted faces of the first and second branches being spaced greater than the depth of the second nail extracting slit.

8. The head as claimed in claim 7, wherein the two lower edges of the chamfered slanted faces of the first and second branches together forming sides of a V-shape.

9. The head as claimed in claim 8, wherein the second nail extracting slit is defined by an arcuate, slanted surface.

10. The head as claimed in claim 9, wherein the first and second inner faces are slanted to guide upward movement of the nail during extraction of the nail.

11. The head as claimed in claim 10, further comprising a third nail extracting slit extending from the end face between the inner and outer surfaces and intermediate the second inner face and the second outer face, with a third branch being defined between the second inner face and the third nail extracting slit and a fourth branch being defined between the second outer face and the third nail extracting slit.

12. The head as claimed in claim 11, wherein the end face of the third branch is a chamfered slanted face extending upward and outward from the third nail extracting slit and the end face of the fourth branch is a chamfered slanted face extending upward and outward from the third nail extracting slit, with the chamfered slanted faces of the third branch and of the fourth branch each including a lower edge and an upper edge, with the third nail extracting slit having a depth from the outer surface, with the lower and upper edges of the chamfered slanted faces of the third and fourth branches being spaced greater than the depth of the third nail extracting slit, the two lower edges of the chamfered slanted faces of the third and fourth branches together forming sides of a V-shape.

13. The head as claimed in claim 8, wherein the third nail extracting slit is defined by an arcuate, slanted surface.

14. The head as claimed in claim 7, further comprising a third nail extracting slit extending from the end face between the inner and outer surfaces and intermediate the second inner face and the second outer face, with a third branch being defined between the second inner face and the third nail extracting slit and a fourth branch being defined between the second outer face and the third nail extracting slit.

15. The head as claimed in claim 14, wherein the end face of the third branch is a chamfered slanted face extending upward and outward from the third nail extracting slit and the end face of the fourth branch is a chamfered slanted face extending upward and outward from the third nail extracting slit, with the chamfered slanted faces of the third branch and of the fourth branch each including a lower edge and an upper edge, with the third nail extracting slit having a depth from the outer surface, with the lower and upper edges of the chamfered slanted faces of the third and fourth branches being spaced greater than the depth of the third nail extracting slit, the two lower edges of the chamfered slanted faces of the third and fourth branches together forming sides of a V-shape.

16. The head as claimed in claim 15, wherein the first and second inner faces are slanted to guide upward movement of the nail during extraction of the nail.

17. The head as claimed in claim 7, wherein the first and second inner faces are slanted to guide upward movement of the nail during extraction of the nail.

18. The head as claimed in claim 7, further comprising a peen opposite to the end to define a hammer head.

19. The head as claimed in claim 11, wherein the third nail extracting slit is of a different size than the second nail extracting slit.

20. The head as claimed in claim 14, wherein the third nail extracting slit is of a different size than the second nail extracting slit.

* * * * *